United States Patent [19]

Oatley

[11] 4,144,869

[45] Mar. 20, 1979

[54] DOMESTIC LOW TEMPERATURE AND WARMING UNIT

[76] Inventor: Gerald A. Oatley, Palma Lodge, Mill La., Codsall, Staffordshire, England

[21] Appl. No.: 794,914

[22] Filed: May 9, 1977

[51] Int. Cl.[2] ..... A21B 1/52

[52] U.S. Cl. ..... 126/19 M; 126/39 C; 126/273 R; 126/275 R

[58] Field of Search ..... 126/19, 19 M, 39 C, 126/273 R, 273 A, 275 R, 275 E, 9 R; 220/8, 85 B; 312/236

[56] References Cited

U.S. PATENT DOCUMENTS

| | | | |
|---|---|---|---|
| 1,456,474 | 5/1923 | Sussman | 126/19 M |
| 1,495,862 | 5/1924 | Meacham | 126/19 M |
| 1,983,110 | 12/1934 | Warrick | 126/273 R |
| 2,798,476 | 7/1957 | Marion | 126/275 R |
| 3,051,157 | 8/1962 | Rice | 126/19 R |
| 3,509,870 | 5/1970 | Sheppard | 126/275 R |
| 4,014,315 | 3/1977 | Lagunilla | 126/275 R |

FOREIGN PATENT DOCUMENTS

| | | | |
|---|---|---|---|
| 234347 | 6/1961 | Australia | 220/85 B |

*Primary Examiner*—Edward G. Favors

*Attorney, Agent, or Firm*—Scrivener, Parker, Scrivener & Clarke

[57] ABSTRACT

A low temperature gas-fired or electrically heated oven and warming unit for domestic purposes having a chamber enclosed by walls and a door at the front. The chamber is variable in volume, for example by being vertically extensible by having overlapping, relatively movable wall portions at the side and back and a door which automatically adjusts to the volume of the chamber for example by being of the tambour or roller shutter type. The unit can be fixed by the top section under a kitchen wall unit and extended downwards for use. Removable, lazy-tongs linkages at the sides of the unit control the extension of the chamber and are jointly operated by a single adjustment control. Shelf supports on the linkages move to alter the spacing of the shelves as the chamber volume is varied.

13 Claims, 11 Drawing Figures

DOMESTIC LOW TEMPERATURE AND WARMING UNIT

Figure 1:
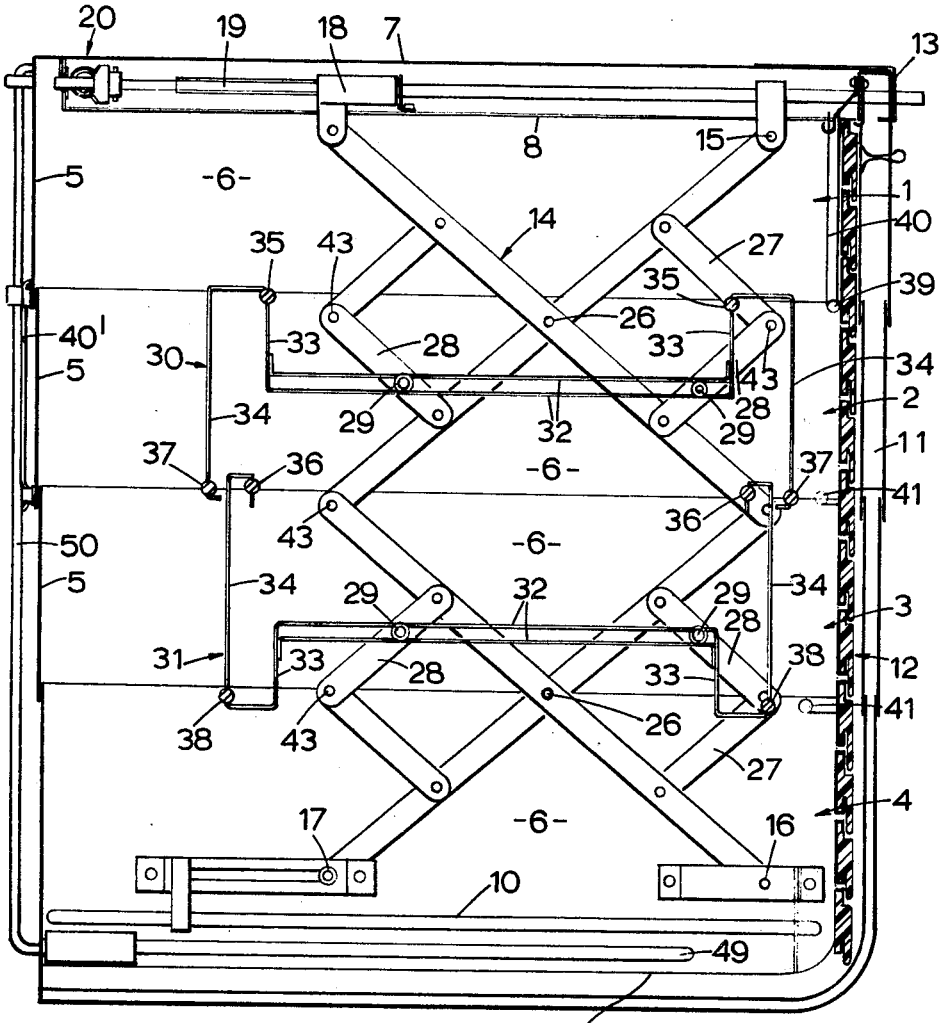

This invention relates to a low temperature oven and warming unit for domestic purposes such as warming plates, keeping meals hot, de-frosting frozen food and low temperature cooking.

Facilities in most home kitchens for these purposes are limited and space is at a premium. Some cookers have no warming facilities other than the oven which is not usually wide enough to take two dinner plates side by side and is often too hot even at its lowest temperature setting. The so-called warming compartment in some cookers is often more of a storage drawer and is not really warm enough or is otherwise ineffective, or it is combined with something else, for example a grill, which if in use for cooking denies use of the compartment for warming purposes.

It is an object of the present invention to provide a low temperature oven and warming chamber as an independent unit which provides warming and low temperature cooking facilities without taking up too much room.

The present invention consists in a domestic low temperature oven and warming unit comprising a chamber which is variable in volume and defined by top, bottom, back and side walls and a door at the front, and heated by gas-fired or electric heating means.

The heating means should be capable of heating the chamber to a temperature of the order of 200° F and maintaining it at such a temperature. At 200° F, for example, meringues can be cooked and will remain white. At the lowest temperatures to which most domestic cooker ovens can be set, they are turned brown. At 150° F the temperature is low enough to stop further cooking of food being kept hot but high enough to prevent the growth of bacteria. The heating means may be controlled by a thermostat which may be set at other temperatures including down to room temperatures to allow for slow de-frosting of some frozen foods.

The volume of the low temperature oven and warming unit is preferably variable by being vertically extensible by means of overlapping, relatively movable wall portions at the side and back. The door opening might be of fixed size but is preferably also variable with the changes in volume of the chamber. The door may automatically adjust to suit the capacity of the chamber, for example, by being of the tambour or roller shutter type opening and closing vertically.

Most kitchens are now fitted with unit furniture which includes wall storage units fitted over base units and spaced above the working surface on the top of the base units. The lower temperature oven and warming unit may be of a plan dimension suitable for mounting under a wall storage unit and is then preferably so constructed that the top remains in a fixed position and the unit is extensible downwards. Means may be provided for supporting the low temperature oven and warming unit which enables it to be attached to the underside of a wall storage unit. The range of adjustment of the volume of the chamber for use in such a situation may be such that at its smallest size there is no significant obstruction of the working surface below and even when fully extended there will still be useful space left above the working surface.

Such a low temperature oven and warming unit could be wall mounted either by securing to the kitchen wall a non-moving part of the back wall of the unit or by the use of wall mounted adaptor brackets which cooperate with the attachment means on the top of the unit.

As the low temperature oven and warming unit is extensible in the direction of its smallest dimension, means is necessary for keeping the unit symmetrical during this movement by a movement control device for example by a linkage, such as a lazy-tongs, to ensure that opposite sides move together. Preferably the linkage is arranged to be operated directly by the user as the means of adjusting the volume of the chamber.

An intermediate shelf or shelves may be provided in fixed or movable positions and supported on the walls of the unit or by the linkage.

In addition to its primary function as a low temperature oven and warming unit, a gas or electric grill may be provided under the top of the chamber and provision may also be made for supporting a rotisserie in the chamber under the grill.

Figure 2:
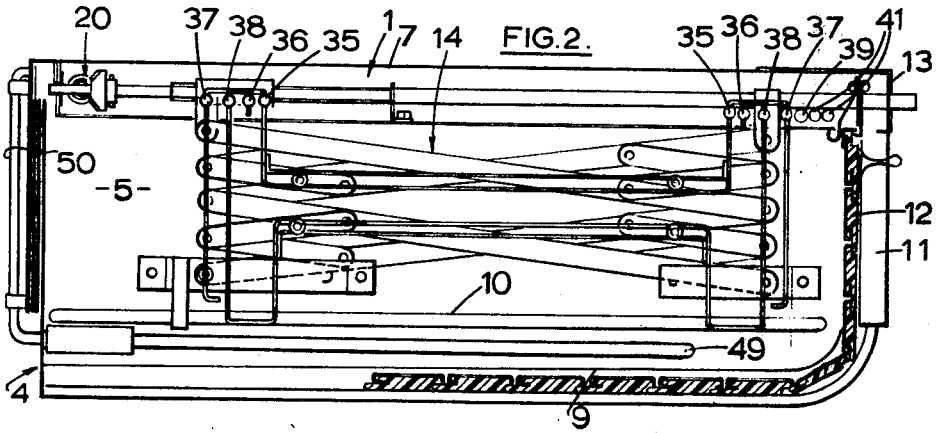
Figure 3:
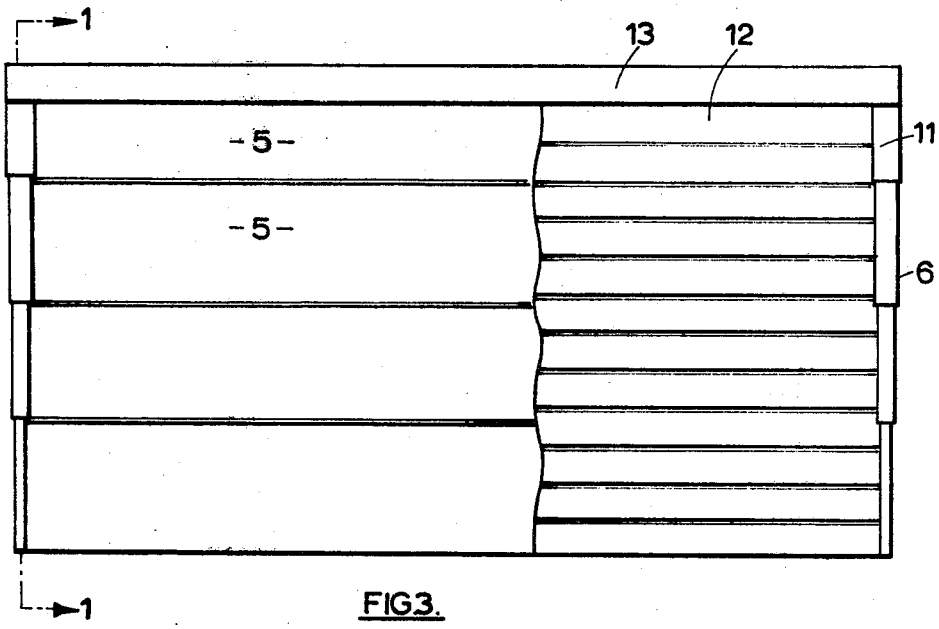
Figure 4:
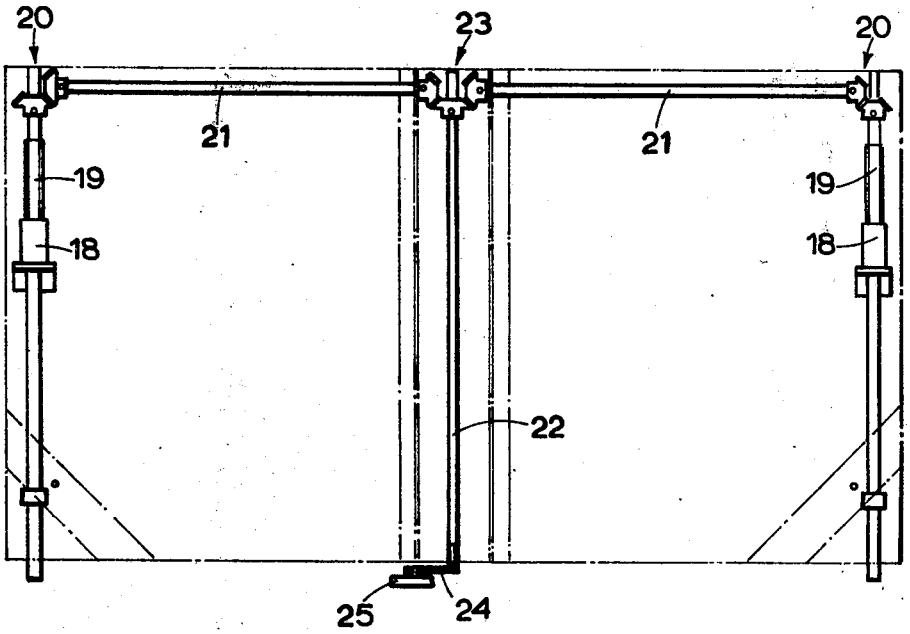
Figure 5:
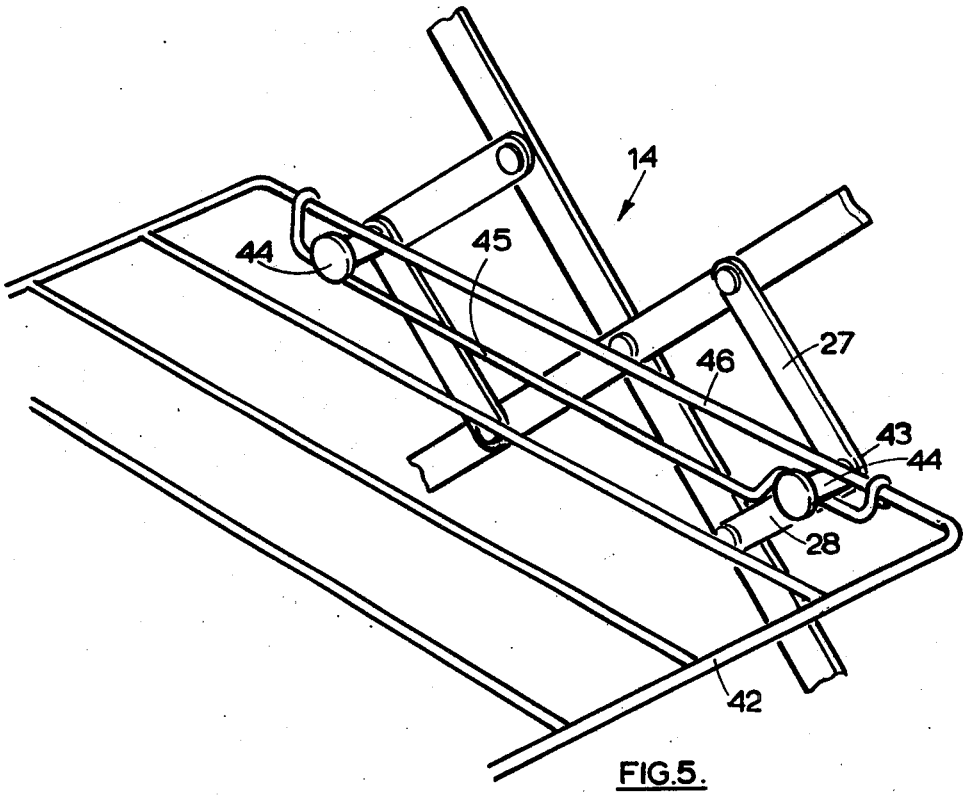
Figure 6:
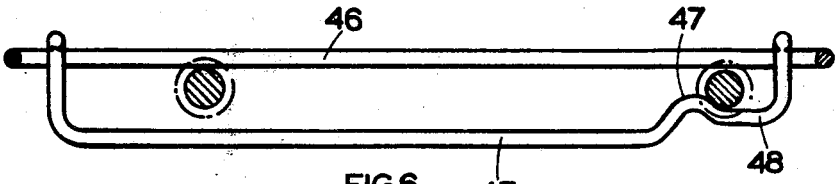
Figure 7:
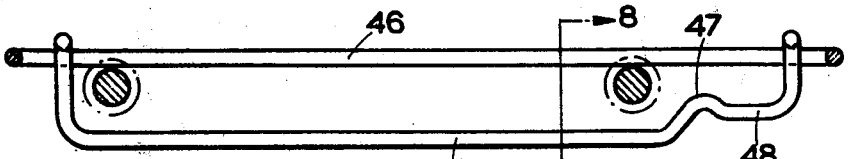
Figure 8:
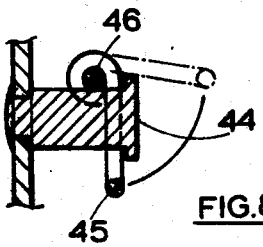
Figure 10:
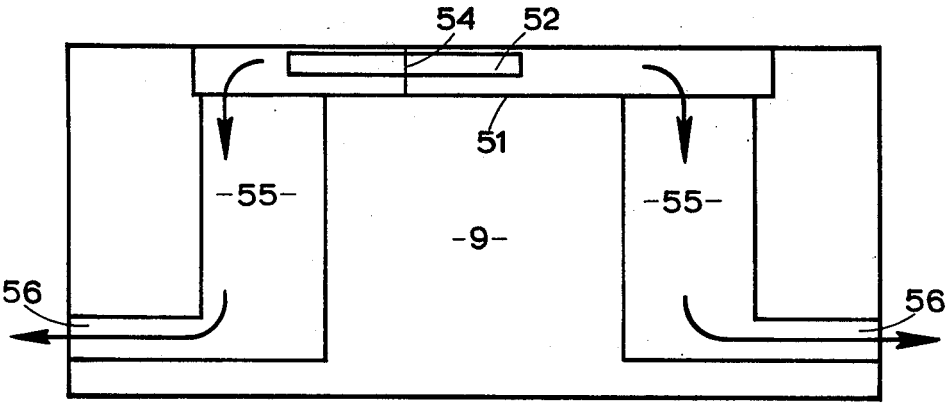
Figure 11:
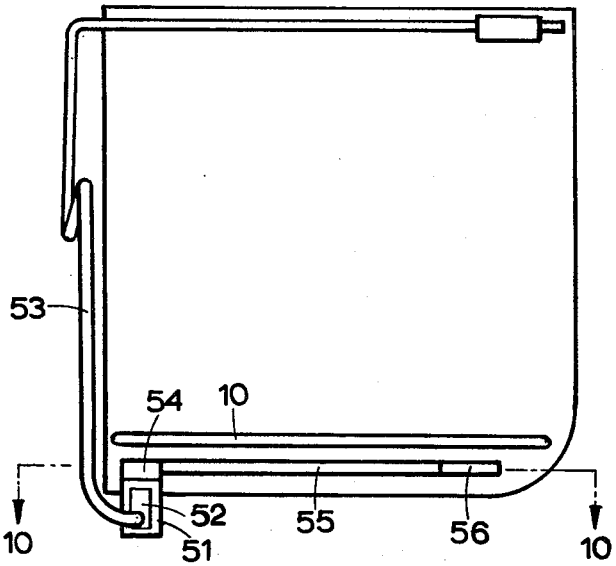
Figure 9:
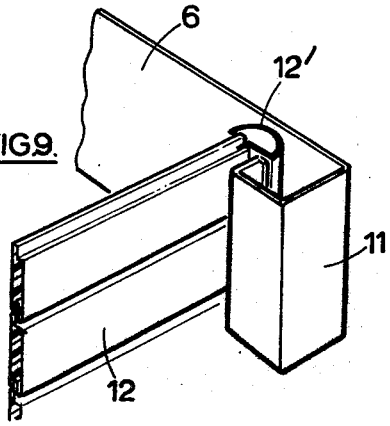

The invention will now be described, by way of example only, with reference to the accompanying diagrammatic drawings in which:

FIG. 1 is a section on line 1—1 of FIG. 3 of an electrically heated domestic low temperature oven and warming unit according to the invention, shown in the extended condition, FIG. 2 is a similar sectional view to FIG. 1 but showing the unit fully contracted, FIG. 3 is a front elevation of the unit partly broken away to show features of the invention, FIG. 4 is a plan view of actuating mechanism of the unit, FIG. 5 is a perspective fragmentary view, FIGS. 6, 7 and 8 fragmentary views and FIG. 9 a perspective view of details of the unit, FIG. 10 is a sectional plan view on line 10—10 of FIG. 11, and FIG. 11 is a sectional side view of the unit modified for gas-firing.

The unit, as can be seen in FIGS. 1 to 4, comprises four telescopic sections, an upper section 1, two intermediate sections 2,3 and a lower section 4 which together enclose an oven or warming chamber. Each of the sections has a rear wall portion 5 and side wall portions 6. The upper section is closed by a top wall panel 7 spaced below which is an oven ceiling lining 8. The lower section 4 has a bottom wall panel 9 spaced above which is a chamber floor grid 10. The rear wall portions 5 and side wall portions 6 of the upper section 1 and intermediate sections 2 and 3 overlap the outside of the corresponding portions of the section below. At the front of the unit the side walls are bent inwards, then rearwards and finally outwards again to form telescopic columns 11 defining the sides of a door opening. A tambour or roller shutter door 12 slides vertically behind the columns 11. The door 12 is made up of horizontal slats of plastics material each lined inside the chamber with metal. Adjacent edges of the slats have snap-engaging portions to connect the slats together and form hinges. Down the ends of the slats is fitted a D-section flexible seal 12', for example of neoprene, which engages the side wall portions 6 (FIG. 9). The door opens by sliding downwards and under the floor grid 10 of the chamber. A releasable catch holds the door in the closed position against a top rail 13 of the upper section 1.

The upper section 1 is provided with means for securing it to the underside of a kitchen wall cupboard. The unit shown in the fully extended condition in FIG. 1 can be contracted by raising the lower section 4 and intermediate sections 2,3 inside the upper section. As the unit contracts the door will remain closed, the lower slats of the door sliding under the floor grid 10.

Extension and contraction of the chamber is controlled by a lazy-tongs linkage 14 close to the inner faces of the overlapping side wall portions 6 at each side of the chamber and constituting a movement control device. Each linkage 14 comprises two X-elements connected end to end. The forward, upper and forward, lower free ends of each linkage are connected to pivots 15, 16 fixed to the upper section 1 and lower section 4 respectively near the front of the unit.

The rearward lower free end of each linkage 14 is connected to the lower section 4 by a horizontally slidable pivot 17. The rearward upper free end of each linkage 14 is pivoted to a nut 18 movable horizontally by rotation of a screw-threaded shaft 19. The shafts 19 on opposite sides of the unit are coupled by bevel gears 20 to aligned cross-shafts 21. A drive shaft 22 is coupled by bevel gears 23 to the inner ends of the cross shafts 21. The drive shaft 22 extends to the front of the unit where it is provided with a foldable crank 24. By rotation of the crank 24 the linkages 14 can be jointly extended or contracted. The arm of the crank 24 is connected by diametral pins to the drive shaft 22 and to a knob 25. When the crank 24 is not required the arm can be swung into line with the drive shaft 22 and pushed inside the unit, the connection between the crank 24 and the drive shaft 22 allowing the necessary sliding movement. The knob 25 remains on the outside of the rail 13 so that the crank 24 can be drawn out again when required.

On each side of each main pivot 26 of the lazy-tongs linkage 14 secondary links 27,28 are connected forming with the adjacent main links a rhombus pivoted at the corners. Near the pivotal connection of each link 28 with the adjacent link of the main linkage headed studs 29 are fixed to the link 28 on the side towards the adjacent side wall portion 6. The linkages 14 are connected to the intermediate sections 2,3 by upper and lower wire hangers 30,31. Each hanger lies in a vertical plane and has a pair of parallel wires 32 which slidably embrace the shanks of pairs of studs 29 at the same level. At each end of the middle portion formed by the parallel wires 32 each hanger continues as a single wire extending first away from the central overlap of the intermediate sections 2,3 (as seen in FIG. 1) in a portion 33, and then horizontally. Finally each hanger 30,31 is turned back towards the central overlap in a straight portion 34 which extends into the horizontal zone of the overlap. A stud 35 is fixed to the wire at the upper end of each portion 33 of the upper hangers 30 and a stud 36 at the upper end of each portion 34 of the lower hanger 31. The studs 35 are fixed to the upper edge of the section 2 and the studs 36 to the upper edge of the section 3. The edges of the sections overlapping the intermediate sections to which the studs 35, 36 are connected are cut away locally, if necessary, to clear the studs.

The actual connections between the studs 35, 36 and the intermediate sections 2,3 are not visible in FIGS. 1 and 2 as the adjacent side wall portions 6 are in front of the sectional planes of FIGS. 1 and 2. The hangers 30,31 connect their respective intermediate sections 2,3 to portions of the lazy-tongs linkage 14 each having a vertical movement less than the vertical movement of the lower end of the linkage and proportional to the distance from the upper end thereof so as to move all the sections progressively upwards as the linkage is contracted and to bring them all finally into full nesting relation, as shown in FIG. 2, in the fully contracted position.

Further studs 37,38 are slidably mounted on the straight portions 34 of the hangers 30 and 31 respectively. The studs 37 are secured to the upper edge of the intermediate section 3 and the studs 38 to the upper edge of the lower section 4. Near the front of the unit a stud 39 secured to the upper edge of the intermediate section 2 is slidable in a narrow wire loop 40 suspended from the top of the upper section 1. A similar loop 40' (FIG. 1) is provided at the rear of the unit to receive a stud (not shown) similar to the stud 39. The studs 37,38,39 are provided to enable the linkages 14 to be made detachable from the unit for cleaning purposes. When the linkages 14 are removed in the extended condition of the unit the sections remain connected and suspended by the hangers 30,31 and loops 40,40'.

At the upper edge of the sections 3 and 4 near the front, guide studs 41 are supported on wire brackets and project behind the door 12 to prevent excessive inward movement of the door. The hangers and studs are so arranged that in the contracted condition as shown in FIG. 2 the studs 35, 36, 37, 38, 39 and 41 do not interfere with one another and all lie at the same level.

Up to three wire shelves 42 (FIG. 5) can be used in the chamber, detachably mounted on the linkages 14. At each intermediate joint 43 of the main linkage 14 and at the junction of the secondary links 27,28, trunnions 44 are provided on the side of the linkage facing the chamber.

A retainer 45 made of wire, is swivelly attached to each end of each shelf 42. The swivelling attachment is made by forming the ends of the retainer 45 into loops around an end member 46 of the shelf. For most of its length the retainer 45 is parallel to the member 46 and spaced away by a distance greater than the diameter of the heads of the trunnions 44. Towards the forward end each retainer is bent to form a restriction at 47 between the retainer and member 46 which is narrower than the shank diameter of the trunnion 44. Further forward still the retainer has a part 48 spaced from the member 46 only slightly more than the shank diameter but less than the head diameter of the trunnion 44. To insert the shelf in the chamber the retainers are swung inwards and held out of the way so that the end members 46 can rest on the shanks of the trunnions 44. With the shelf slightly forwards the retainers can be swung downwards over the heads of the trunnions as shown in FIGS. 7 and 8. Pushing the shelf rearwards causes each retainer to flex at the restriction 47 so that the front trunnion 44 can pass into the narrower forward portion next to the part 48 (FIG. 6). In this position the retainer is prevented by the trunnion head from swinging sideways and the shelf is sufficiently located both vertically and horizontally. The front trunnions 44 are trapped in the narrow forward portion but the rear trunnions are free to slide horizontally along the retainer to allow vertical adjustment of the unit. During such vertical adjustment the intermediate shelves remain evenly spaced from each other. The shelves can be removed by reversal of these movements, the shelf first being pulled forwards to spring the front trunnion past the restriction 47.

The chamber is heated by a tubular sheathed electric heating element 49 distributed over the bottom wall panel 9 and below the floor grid 10. A flexible cable 50 at the back of the unit connects the heating element 49 to a thermostat switch (not shown) mounted in the upper section 1 and having a manual control on the top rail 13.

In the unit modified for gas-firing shown in FIGS. 10 and 11, a housing 51 is provided below the middle of the rear of the bottom wall panel 9 and contains a flame-failure device and an elongated burner 52. Gas is supplied to the burner through a pipe 53 coiled in the middle into a full turn and shaped to afford sufficient flexibility for adjustment of the chamber height. The upper end of the pipe 53 is connected to a gas tap and thermostatic valve (not shown) with controls on the top rail 13.

Above the burner 52 is a vertical partition 54 to divide the hot products of combustion between two shallow but wide flue passages 55 provided between the bottom wall panel 9 and the floor grid 10. The flue passages 55 extend forwards and are connected to flue outlets 56 near the bottom forward corners of the side wall portions 6 of the lower section 4. The flue passages heat the chamber indirectly by radiation and convection.

Indirect heating is preferred as this reduces the change of atmosphere in the warming chamber so that covering of food to avoid drying up is less necessary. Alternatively, the products of combustion could be allowed into the warming chamber for direct heating and to leave it at a suitable point to ensure sufficient circulation for even heat distribution.

The elements of the warming unit whether electrically heated or gas-fired may conveniently be made from sheet metal, aluminium for example. External dimensions of a typical unit are about 24 ins. long, 13 ins. deep (from front to back) and 5 ins. high in the contracted condition, extending to about 13 ins. high. These dimensions are convenient for a unit to be mounted under a pair of wall storage units which are typically 12 ins. deep from front to back and each 21 ins. long. These dimensions are slightly less for metric kitchen unit furniture.

I claim:

1. A domestic oven and warming unit comprising a chamber which is variable in volume and defined by top, bottom, back and side walls and a door at the front; and means for heating the chamber, the door being variable in size with changes in volume of the chamber.

2. A domestic oven and warming unit according to claim 1 in which the chamber is variable in volume by having overlapping relatively movable wall portions each forming part of both the back and side walls, the chamber being vertically extensible by relative movement between the wall portions.

3. A domestic oven and warming unit according to claim 1 wherein the door is of the tambour or roller-shutter type opening and closing by vertical movement.

4. A domestic oven and warming unit according to claim 1 wherein the unit is adapted to be secured by an upper part of the unit to a room wall or to the underside of a wall storage unit and a lower part of the unit is movable to vary the volume of the chamber.

5. A domestic oven and warming unit according to claim 1 wherein a linkage is provided at each side of the unit, the unit having upper and lower sections including the top and bottom walls respectively, the linkages connecting the upper and lower sections and operating together to maintain the top and bottom walls parallel to one another during adjustment of the volume of the chamber.

6. A domestic oven and warming unit according to claim 5 wherein each movement control device is a linkage of the lazy-tongs type.

7. A domestic oven and warming unit according to claim 5 wherein the movement control devices are linkages directly manually operable affording means of adjusting the volume of the chamber.

8. A domestic oven and warming unit according to claim 5 wherein at least one intermediate section comprising back and side wall portions is connected to a part of each movement control device, which part has a smaller vertical movement during adjustment of the volume of the chamber than there is between the ends of the linkage connected to the upper and lower sections.

9. A domestic oven and warming unit according to claim 5 wherein the movement control devices are detachable from the unit and means is provided for linking relatively movable parts of the unit normally connected by the linkages.

10. A domestic oven and warming unit comprising a chamber which is variable in volume and defined by top, bottom, back and side walls and a door at the front; means for heating the chamber, a movement control device at each side of the unit, the unit having upper and lower sections including the top and bottom walls respectively, the movement control devices operating together to maintain the bottom wall parallel to the top wall during adjustment of the volume of the chamber, and at least one shelf spaced from the top and bottom walls and which is moved vertically as a consequence of adjustment of the volume of the chamber.

11. A domestic oven and warming unit according to claim 10 wherein the shelf is supported by parts of the movement control devices which move vertically during adjustment of the volume of the chamber.

12. A domestic oven and warming unit with an oven chamber which is variable in volume and comprising relatively vertically movable telescoping sections including an upper section from which the other sections are suspended having a top wall and back and side wall portions, a lower section having a bottom wall and back and side wall portions and at least one intermediate section having back and side wall portions; a door closing an open front of the chamber; means on the upper section for mounting the unit on a fixed structure; means for controlling relative movement of the sections and operative to maintain the bottom wall parallel to the top wall during adjustment of the volume of the chamber, manually operable means for selectively adjusting the volume of the chamber and means for heating the chamber.

13. A domestic oven and warming unit according to claim 12 having a thermostatic control capable of being set to temperatures in the range 200° F to 150° F.

* * * * *